US008704667B1

(12) United States Patent
Hatheway

(10) Patent No.: US 8,704,667 B1
(45) Date of Patent: Apr. 22, 2014

(54) SYSTEM AND METHOD FOR RECEIVING DATA, ANALYZING DATA, AND INITIATING OUTPUTS BASED UPON THE ANALYZED DATA

(76) Inventor: Robin Brou Hatheway, New Orleans, LA (US)

( * ) Notice: Subject to any disclaimer, the term of this patent is extended or adjusted under 35 U.S.C. 154(b) by 20 days.

(21) Appl. No.: 13/551,456

(22) Filed: Jul. 17, 2012

Related U.S. Application Data

(60) Provisional application No. 61/508,714, filed on Jul. 18, 2011.

(51) Int. Cl.
*G08B 23/00* (2006.01)

(52) U.S. Cl.
USPC ..... 340/573.1; 340/506; 340/539.19; 340/540

(58) Field of Classification Search
USPC ..... 340/573.1, 506, 539.1, 539.19, 540, 340/541; 455/404.1, 404.2; 706/45, 46
See application file for complete search history.

(56) References Cited

U.S. PATENT DOCUMENTS

2003/0197608 A1* 10/2003 Rudhard et al. ..... 340/539.18
2008/0177688 A1* 7/2008 Friedlander et al. ..... 706/46
2009/0029672 A1* 1/2009 Manz ..... 455/404.2

* cited by examiner

*Primary Examiner* — Hung T. Nguyen
(74) *Attorney, Agent, or Firm* — Andrew G. Vicknair

(57) ABSTRACT

A system and method for receiving user data, analyzing the user data, and generating outputs based upon the analysis of user input data in conjunction with various other data. Specifically, the present invention relates to an electronic "nanny" system to analyze personal appointment data for meetings or appointments attended by individuals and generate outputs to various emergency contacts for the purpose of notifying the emergency contacts that a user of the system has not checked back with the electronic "nanny" system and may therefore be in trouble or in a dangerous situation.

20 Claims, 3 Drawing Sheets

*FIG.* 3
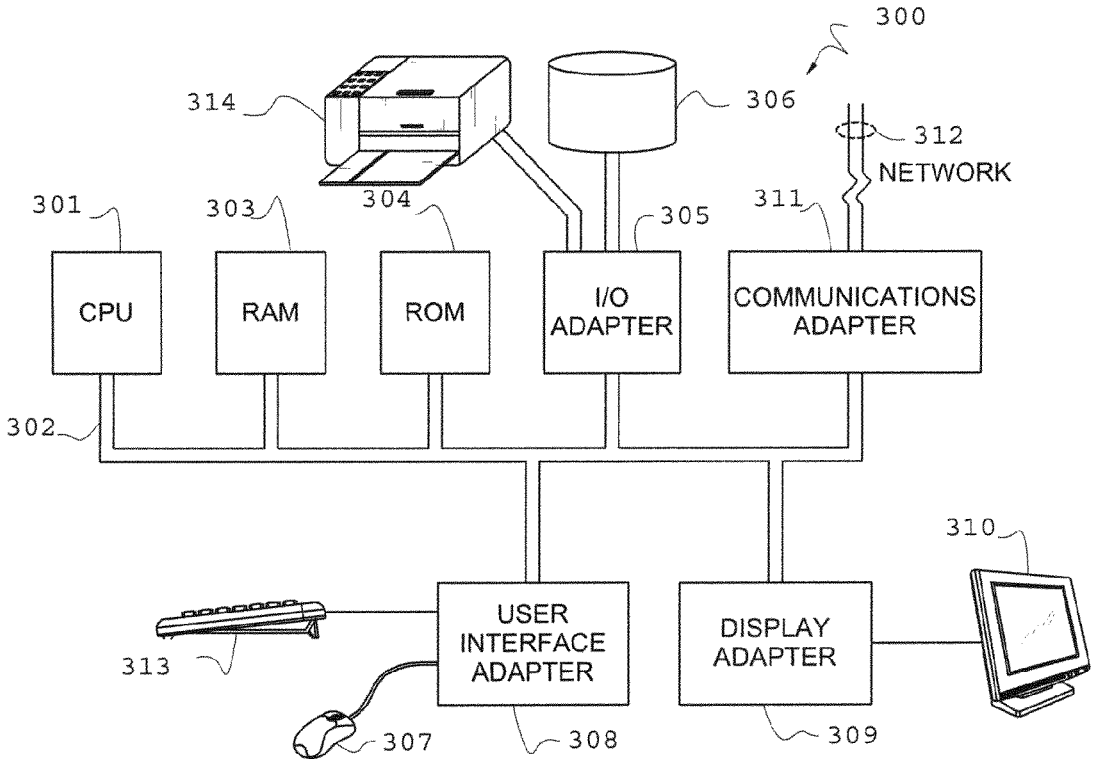

SYSTEM AND METHOD FOR RECEIVING DATA, ANALYZING DATA, AND INITIATING OUTPUTS BASED UPON THE ANALYZED DATA

CROSS REFERENCE TO RELATED APPLICATIONS

This application claims the benefit of U.S. provisional application Ser. No. 61/508,714 filed on Jul. 18, 2011.

TECHNICAL FIELD

The present invention relates, in general to a system and method for receiving user data, analyzing the user data, and generating outputs based upon the analysis of user input data in conjunction with various other data. Specifically, the present invention relates to an electronic "nanny" system that may analyze personal appointment data for meetings or appointments attended by individuals and generate outputs to be used as identifiers of potential problems, such as text messages sent to previously identified individuals that contain some type of message that a user of the system has not checked back with the electronic "nanny" system and may therefore be in trouble or in a dangerous situation.

BACKGROUND OF INVENTION

Currently, millions of individuals in the course of everyday activities schedule appointments, both social and work related, that place these individuals in new environments involving new contacts whereby the new contacts/strangers are approached and met with for the first time. For example, salespersons, real estate agents, at home nurses and others involved in careers or activities requiring the individual to be traveling to meet new contacts are often put in a situation of meeting a new contact in a new location that others, such as the individuals' loved ones, friends, or family members, may not be aware of exactly where the individual went for the meeting with the new contact. In addition, with the increase in popularity of online dating websites, individuals through the course of online dating, often arrange meetings with strangers that they have never met before. In doing so, individuals are hesitant about notifying or may be embarrassed to notify friends and/or family members that they are meeting someone that they met through an online dating website. In such a scenario, the individual proceeds to meet with the stranger and usually that individual is the only person who knows of the meeting/appointment.

If the appointment does not work out or in the event that the stranger/new contact turns out to be a dangerous individual, then the circumstances may exist whereby no-one knows where the individual is located and there would be no way of knowing if the individual meeting the new contact/stranger is in danger or not. This scenario raises safety concerns and may even discourage individuals from meeting with potential new contacts. In addition, if no one knows where the individual went to meet with the new contact/stranger, then it is nearly impossible for someone to follow up or check-up on the individual that is on an appointment with a new contact/stranger that may have turned bad for one reason or another, such as a meeting/secret appointment arranged through an online dating site. While the individual may have a cell phone that could be used to call for help, often times the cell phone may not work, may be out of coverage, or the new contact/stranger may have taken the cell phone away from the individual—leaving the individual in a helpless state of not being able to contact anyone for help.

Accordingly, a need exists for a system and method that allows individuals to personally and privately log appointments of any kind and in the event that an individual does not check in or report back to the appointment logging system with a status update, then an output may be generated that will notify third parties, such as family members and/or friends that the individual may be in danger. In doing so, family members and/or friends may be notified of the details of the appointment thereby enabling the family members and/or friends to check-up on or follow up with the individual to determine if the individual is safe or in danger.

BRIEF SUMMARY OF THE INVENTION

The present invention is directed to a system and method for logging appointments and notifying various individuals/contacts of a potential dangerous or unsafe situation if a user fails to check back in or report back safely when the user may be in a situation where he/she is simply unable to personally notify his/her contacts. The present invention may receive data, such as appointment or event data, input from various sources, analyze the data, and generate output based upon a number of user defined criteria. The system can take data input by a user, such as the time and location of an event or meeting the individual/user may have with a stranger or new acquaintance, compare this data to user defined criteria, and then generate some type of output depending upon the outcome of the data analysis. The generated output may be used to notify third parties, such as family members and friends, that the user had an event, meeting, and/or social outing with a stranger, but the user did not check in or report back to the system to indicate that the meeting and/or social outing is progressing forward safely. The present invention also allows users to track appointments and alert third parties of scenarios when a user may be in danger or in need of assistance without the user ever having to actually contact the third party personally as the present invention will generate the messages and contact the third party.

In one embodiment, the present invention will include user profiles specific for each user. After a user has created a user profile, the user will input event/meeting data, user-specific data and the system will collect and store user-specific data about an upcoming appointment or event of any kind, such as a social or work related appointment or event. A user will then select and/or input user specific criteria that may be used by the system as a benchmark for comparing user input data to user specified criteria. If a user does not check back in or report back with the system and input updated information, depending on a user's criteria, the system may generate certain output, such as a text message, an email or a pre-recorded message, whereby this output may be sent to a third party contact, whereby the generated output is preferably related to the individual's appointment. For example, if a user were meeting a stranger for a blind date, the user can input data about the blind date and the stranger, and then the user may designate any number of third parties, family members or friends, to be contacted with information about the blind date in the event that the user does not input new data to the system indicating that the blind date is progressing safely and the user is safe.

The foregoing has outlined rather broadly the features and technical advantages of the present invention in order that the detailed description of the invention that follows may be better understood. Additional features and advantages of the invention will be described hereinafter, which form the subject of the invention. It should be appreciated that the conception and specific embodiment disclosed may be readily utilized as a basis for modifying or designing other structures for carrying out the same purposes of the present invention. It should also be realized that such equivalent constructions do not depart from the invention. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which:

FIG. 3 depicts a block diagram of a computer system which is adapted to use an embodiment of the present invention.

DETAILED DESCRIPTION OF THE INVENTION

Figure 1:
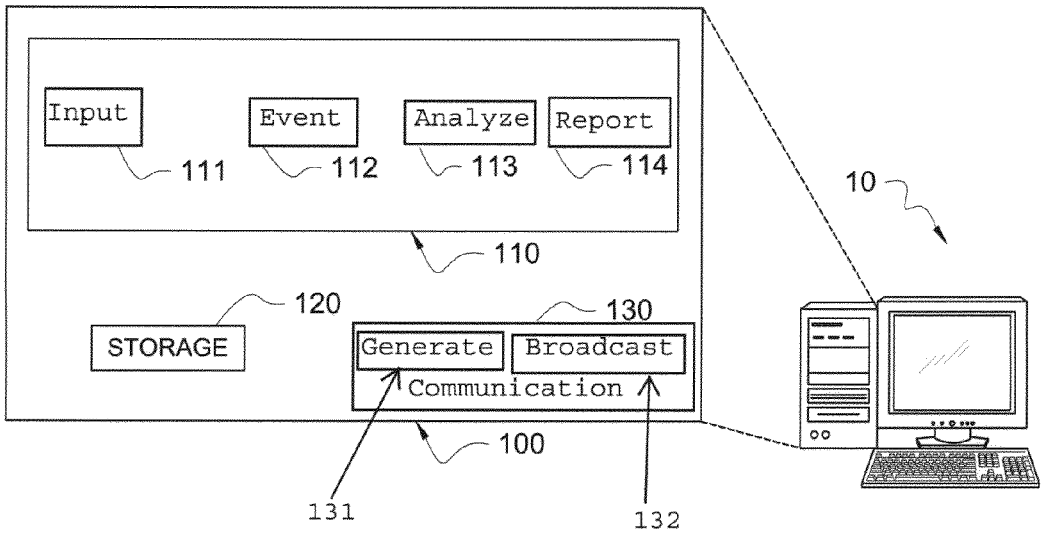
FIG. 1 is an illustration of a general architecture of a system of one embodiment of the present invention.

FIG. 1 is a diagram illustrating appointment data input-analysis-message generation environment 100 according to one embodiment of the present invention implemented on computer 10 for monitoring a user's events or appointments, accepting user data, analyzing user data, and generating output data/messages based upon the analysis of appointment or event data in conjunction with certain user defined criteria or settings. Environment 100 allows a user's appointments or events, such as blind dates, business meetings with new contacts, meetings with strangers, nighttime social activities, or meetings in new locations and new environments to be monitored. In the event that a user does not check back in or provide updated data related to an appointment, output data and/or a message may be generated and communicated to individuals or emergency contacts selected by the user for the purpose of notifying the individuals/emergency contacts that the user has not checked in and may be in a dangerous/unsafe situation or environment. The output messages can be generated and sent to the emergency contacts without the user having to first notify the individual/emergency contact that the user is planning on attending a specific appointment or outing that the user may wish to keep secret, unless an emergency situation arises and the user needs help.

Data input-analysis-message generation environment 100 represents one application running on computer 10. While computer 10 in FIG. 1 is illustrated as a desktop computer, the present invention is not limited to use on any specific type of computer. In some embodiments, the present invention may be configured as an application/program designed to operate/run on some type of smart phone, personal digital assistant, or tablet computer or other device. In one embodiment of the present invention, data input-analysis-message generation environment 100 includes data module 110, storage module 120, and communication module 130. Data module 110 may also include input sub-module 111, event sub-module 112, analysis sub-module 113 and report sub-module 114. Data input-analysis-message generation environment 100 is advantageous as it may be used to assist in creating user profiles from user data, create events/appointments related to a specific user appointment/event, analyze the event/appointment data and the user profile data to determine what output messages, if any, should be generated and where said messages should be sent. Environment 100 may also generate reports of user events/appointments and any actions taken with respect to a particular event/appointment.

Although FIG. 1 illustrates data module 110 with only four sub-modules, input sub-module 111, event sub-module 112, analysis sub-module 113 and reporting sub-module 114, the present invention is not limited to this configuration. In alternative embodiments of the present invention, data module 110 may include several other sub-modules in addition to sub-modules 111, 112, 113, and 114.

Data module 110 functions to process and receive all data input by a user, such as a user profile, to process and receive a user's appointments or events that are to be tracked and logged by environment 100, to analyze event/appointment data and compare that data against any number of data entries or data fields previously input by a user or previously configured by a user in a user's profile. Data module 110 may also generate data reports based upon user data, event/appointment data, message generation and broadcasting data and the like. For example, in one embodiment, a user may be able to access his/her account and request a data report that displays information or data about that user's recent activity contained in the system.

In some embodiments, input sub-module 111 operates to receive and process all user data input into the system, such as name, address, contact information, date of birth, email address, age, and the like. In one embodiment, data module 110 may be configured to locate pre-existing contact information that may already be present on computer 10 (where data input-analysis-message generation environment 100 may be operating) and then provide the user with the option to select and import any of said pre-existing contact information into data input-analysis-message generation environment 100. In some embodiments, the present invention may be configured so that the pre-existing information is not imported into data input-analysis-message generation environment 100 but is merely flagged for use and can be used as contact information in data input-analysis-message generation environment 100. For example, if data input-analysis-message generation environment 100 were running on a user's desktop computer, smartphone or other similar device that contained an address book with the user's pre-existing contact data, such as telephone numbers and email addresses of the user's contacts, then data module 110 may locate the user's contact data and provide a user with the option to use the pre-existing contact data for any purpose, such as use as emergency contact data, instead of requiring a user to re-enter contact data into the present embodiment. In such a configuration, the location of the pre-existing contact data and prompting of the user may be accomplished by input sub-module 111 or analyze sub-module 113. Such configuration is not a limitation of the present invention, as in other embodiments, the present invention may be configured so that other sub-modules carry out these functions.

Input sub-module 111 may also operate to allow users to enter various default settings, such as a threshold wait time associated with the process of user's checking back in to the present invention and providing updates about the status of a specific event or appointment. For instance, in one embodiment, the present invention may be configured so that if a user does not check back in within the set threshold wait time, such as 1 hour from the start time of a specific event or appointment, then the present invention may generate and broadcast a message to the user's named emergency contact(s) to alert the emergency contact(s) of the fact that the user has not yet checked back in or reported that the specific event or appointment is progressing along normally or that the user is safe. With input sub-module 111, a user may also select user specific default settings that will be later analyzed by analyze sub-module 113 in processing data to determine if a message should be generated and broadcasted to an emergency contact identified by a user. For example, a user may select a default setting of 2 hours from the start time of an event or appointment or any other time period specified by the user. This default setting may then be used by the present invention to later determine when and if a message should be generated and broadcast to an emergency contact. The present invention may also be configured so that input sub-module 111 processes the type of message and contents of a message to be generated and sent to emergency contacts. For example, a user, when setting up a user profile, may create a template for a message that will be a default message to be used each time a message is sent to an emergency contact for that user.

In processing and receiving said data, input sub-module 111 may convert said data into any number of other formats to enable the present invention to process data in other formats or for the purpose of securing user data. In the present embodiment, when a user first enters into or accesses the system and chooses to register or create a user profile with the present invention, input sub-module 111 may operate to process all initial user information, such as personal data, payment data, and contact information of the user's third parties that are selected and/or entered by the user as an emergency contact in the event that the present invention is required to generate a message and broadcast said message to said emergency contact. Payment information may be credit card data, e-check information, or may be information related to some type of online payment or e-commerce payment system, such as PayPal and the like.

In one embodiment, the present invention may handle and process all aspects of payment from users choosing to utilize the present invention. In such an embodiment, the payment process may be handled in input sub-module 111. In alternative embodiments, the present invention may be configured so that payment from a user for access to the present invention is done only through some type of third party e-commerce business, such as PayPal.

In one embodiment, event sub-module 112 operates to manage and process all events or appointments input by users of the system. In the present invention, an event or appointment that is monitored by the present invention may be some type of appointment, meeting, or outing that a user will be attending that the user will input/enter into the present invention for the purpose of having the present invention analyze the event and generate a message to a third party emergency contact if the user is unable or does not check back in with the present invention to indicate that the event/appointment is progressing along with no problems and the user is safe.

In one embodiment of the present invention, data module 110 may be configured to locate pre-existing event and/or appointment data that may already be present on computer 10 (where data input-analysis-message generation environment 100 may be operating) and then provide the user with the option to select any of said pre-existing event and/or appointment data as the event and/or appointment that is to be monitored by the present invention. For example, if data input-analysis-message generation environment 100 were running on a user's desktop computer, smartphone or other similar device that contained a calendar with the user's pre-existing event and/or appointment data, such as dates and times of events and/or appointments the user will be attending, then data module 110 may locate the user's pre-existing event and/or appointment data and provide a user with the option to select any of the pre-existing event and/or appointment data as the event to be monitored instead of requiring a user to enter event and/or appointment data. In such a configuration, the location of the pre-existing event and/or appointment data and prompting of the user may be accomplished by event sub-module 112 or analyze sub-module 113. Such configuration is not a limitation of the present invention, as in other embodiments, the present invention may be configured so that other sub-modules carry out these functions.

In one embodiment, event sub-module 112 allows a user to create an event or appointment, view any and all events input/entered for that user, and allows a user to change any details associated with an event. Event sub-module 112 may also operate to allow users to input specific settings for a particular event, such as an event specific message to be sent to the emergency contact that is only used for a particular event. In addition, a user may configure the default threshold wait time for a specific time for a particular event. For example, if a user is creating an event that involves a second or third meeting with a new acquaintance, the user may want to extent the threshold wait time as the user may feel safer than the user would feel in a first time meeting with a complete stranger. In such a scenario, the user may set the threshold wait time to 4 hours from the start of the event. In some embodiments, the present invention may also be configured so that event sub-module 112 may operate to categorize or sort event or appointment data by any number of criteria, such as date, location, time, and the like. This is helpful in that it can allow users to sort event data or locate event data based on sorting.

In one embodiment, analyze sub-module 113 operates to analyze event or appointment data and user settings, such as user profile settings. In one embodiment, analyze sub-module 113 operates to compare various user data against other sources of data, such as pre-configured data, event or appointment data, user status data, threshold time limit data, and the like. Analyze sub-module 113 may perform any number of actions based on said data comparison and analysis. For example, analyze sub-module 113 may analyze the appointment data and determine that a user is on a blind date in which a user has previously set a threshold time limit of 3 hours whereby the user must check back with the system within 3 hours of the start of the date or within 3 hours of some pre-determined and identified time. If the user does not check back in within that particular threshold time limit, analyze sub-module 113 will detect the user's failure to check back in and will then determine when and if a message should be generated, what type of message should be generated and to whom the message should be sent, and may later send out a message, such as a reminder message to the user to check back in or a message to an emergency contact in order to notify the emergency contact that a user may be in trouble.

In one embodiment, report sub-module 114 operates to generate reports of data selected by users and/or input to data input-analysis-message generation environment 100. Users or approved third parties may need access to various data contained within data input-analysis-message generation environment 100. In such a situation, report sub-module 114 can generate reports for ease of access to data within environment 100.

Storage module 120 enables the saving and storing of data, such as user profile data, event/appointment data, and data related to messages generated and output by the present invention. After users have input personal data making up their profiles, after events/appointments have been created, after reports have been created, and messages generated, storage module 120 allows the user to save all or any of these data records and reports. Storage module 120 may also allow a user to save any data analyzed during the data input-analysis-message generation process. For example, if the data analysis reveals that messages are continuously generated and communicated to emergency contacts for blind date events in a particular location, users can store that data about that particular location where this data can be retrieved by a user at a later date. In addition, storage module 120 may be configured so that data is stored in a simple database format that is easily retrievable and readable so that others may obtain access to said data. Such configuration is advantageous as situations may arise where various agencies or departments, such as police departments, investigators, etc. may request or demand access to such data in various instances, such as when a user of the system is missing and the data can be used to assist in the investigation concerning such a missing person.

Communication module 130 enables the system to communicate with others and access external data sources that may be reviewed by the present invention when data is analyzed by analysis sub-module 113. In some embodiments, communication module 130 may also include generate sub-module 131 and broadcast sub-module 132.

Although FIG. 1 illustrates communication module 130 with only two sub-modules, generate sub-module 131 and broadcast sub-module 132, the present invention is not limited to this configuration. In alternative embodiments of the present invention, communication module 130 may include several other sub-modules in addition to sub-modules 131 and 132.

Communication module 130 via generate sub-module 131 and broadcast sub-module 132 may function to take action upon the occurrence of some event that may be detected by analysis sub-module 113. For example, if a user has configured the present invention to monitor a new event, and the user has failed to check back in to the system indicating that the user is safe within the user specified time limit, then analysis sub-module 113 may detect the failure of the user to check back in and prompt communication module 130 to take appropriate action, such as sending a message to the previously identified third party emergency contact(s) or sending a reminder message to the user reminding the user that it is time to report back or update the user's status with the system. In taking action, generate sub-module 131 may generate some type signal, such as a sound signal, a vibration signal, a light signal, an electronic message, an email, a Short Message Service (SMS) message, a text message, a timing mark, a phone call, any combination of the above, and the like. In conjunction with the generation of some type of output, broadcast sub-module 132 may function to broadcast the signal/output generated by generate sub-module 131 to any number of destinations, such as a cellular and/or landline telephone, a personal digital assistant (PDA), a beeper, a radio, a scanner, a computer, any combination of the above, and the like. In addition, the present invention may be configured so that when some type of output is generated and broadcast, a signal may be sent which will result in triggering Push Notifications to forward notifications from the servers of third party applications to various devices; such as Apple® devices (i.e. iPhones, iPads) where such notifications may include badges, sounds or custom text alerts.

The program code segments making up data input-analysis-message generation environment 100 can be stored in a computer readable medium or transmitted by a computer data signal embodied in a carrier wave, or a signal modulated by a carrier, over a transmission medium. The "computer readable medium" may include any medium that can store or transfer information. Examples of the computer readable medium include an electronic circuit, a semiconductor memory device, a ROM, a flash memory, and erasable ROM (EROM), a floppy diskette, a compact disk CD-ROM, an optical disk, a hard disk, a fiber optic medium, a radio frequency (RF) link, etcetera. The computer data signal that can propagate over a transmission medium such as electronic network channels, optical fibers, air, electromagnetic, RF links, etcetera. The code segments may be downloaded via computer networks such as the Internet, Intranet, and the like.

Figure 2:
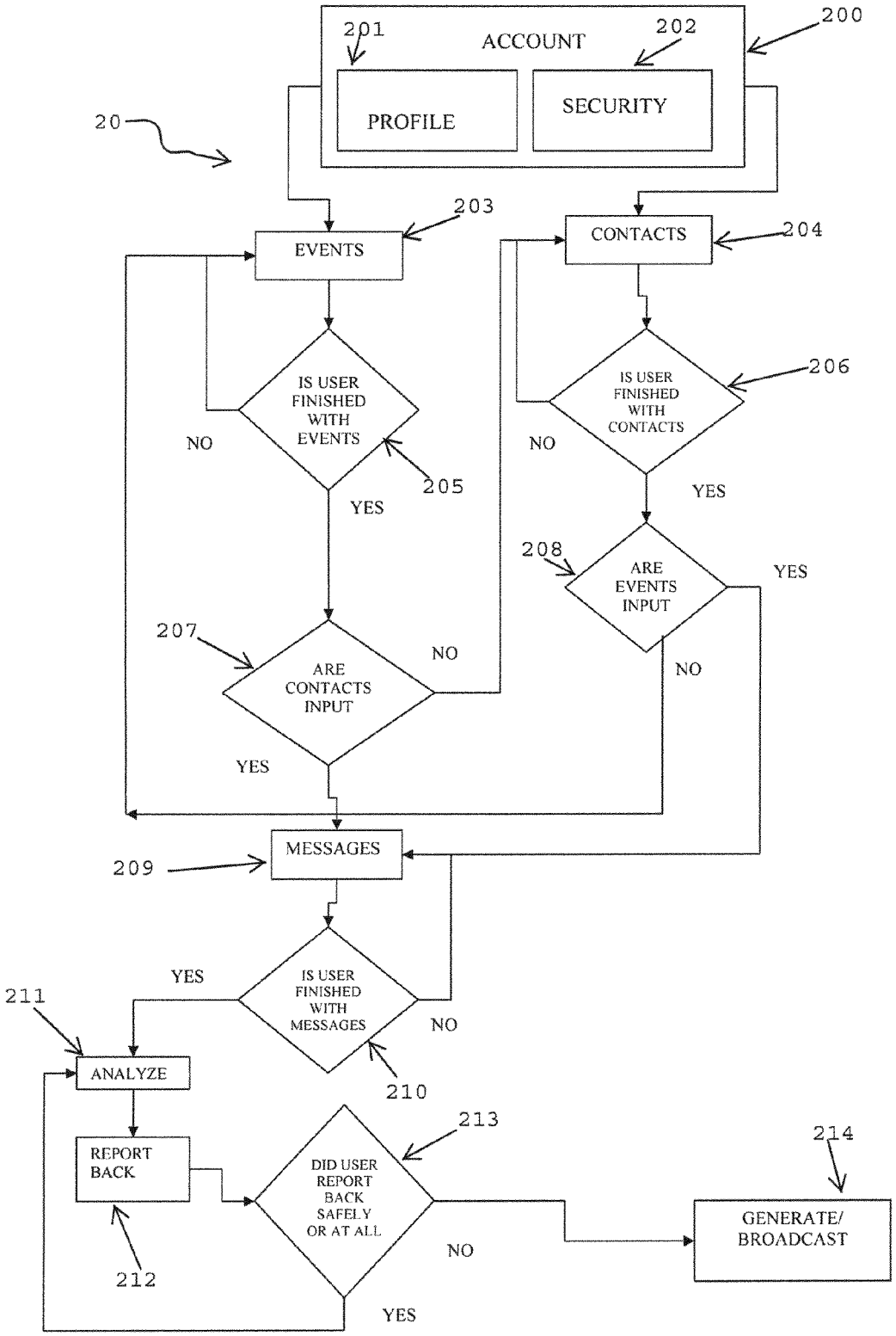
FIG. 2 illustrates a flowchart illustrating steps implemented in an embodiment of the present invention.

FIG. 2 is a flowchart/diagram illustrating sample steps implemented in monitoring a user's events or appointments, accepting user data, analyzing user data, and generating output data/messages based upon the analysis of appointment or event data in conjunction with certain user defined criteria or settings. Flow 20, illustrated in FIG. 2 represents a method for analyzing, querying, and comparing data related to user input events and using the analyzed data to determine the status of a user and user specific events to later determine when and if a message should be generated and broadcast to an emergency contact identified by a user.

While the blocks in FIG. 2 represent part of flow 20, the various numbers are used to identify components of the diagrams and are not limitations of the present invention and do not indicate a specific order of flow of the present invention. Further, the flow of the present invention and the various processes represented in FIG. 2 may be run in parallel and are not restricted by the position in FIG. 2.

User accounts are activated and created in block 200. In block 201, a user profile may be presented to a user with default settings. The user is able to edit the user profile and all settings associated with the user profile to his/her desired setting. For example, the user may enter contact information, payment information, or any other similar information that a user may wish to enter as part of his/her user profile. In block 202, a user is given the chance to create security settings associated with his/her account and user profile. For example, in block 202, a user can select a password and other security settings to protect and secure his/her user account and user profile settings. In block 200, a user is also able to choose a threshold time to be utilized by the present invention in determining when and if a message is to be sent to a user's emergency contacts. For example, if a user is meeting a new individual for dinner on a blind date, a user can choose a threshold time limit 4 hours to be associated with this event. If a user does not check back in or report back that he/she is safe at the end of the 4 hour threshold time limit, then the present invention may proceed to generate a message to the user's emergency contacts. The present invention is not limited to simply establishing a threshold time limit. In some embodiments, the threshold may be based on any number of criteria depending upon the nature of the new event/appointment and the user's settings. Once a user's profile and account is created, flow 20 may proceed to blocks 203 and 204.

In block 203, a user enters and creates his/her events and/or appointments or a user may select an event from pre-existing event and/or appointment data, which may have been located and selected from a user's calendar located on the device running the present invention, that will be monitored with the present invention. In entering event/appointment data, a user may enter various pieces of data about a particular appointment, such as the location, the name of the person that the user is meeting at the event/appointment, reason for the meeting, when was the meeting first scheduled by the user, how long has the user known the person that he/she is going to meet at the appointment/event, and the like. If the user is selecting pre-existing appointment data gathered from a calendar, the user may enter additional data that may not be present in the pre-existing data, such as any one or more of the location, the name of the person that the user is meeting at the event/appointment, reason for the meeting, when was the meeting first scheduled by the user, how long has the user known the person that he/she is going to meet at the appointment/event, and the like. In block 203, a user may also be given the opportunity to view the event to double-check and/or review all data input for a specific event. A user is also provided with the opportunity to edit and/or alter any threshold time limits or other criteria previously established in the user's settings for each event entered and/or selected by the user. In addition, a user is able to enter several events/appointments based on a user's needs. A user is also provided with the means to manage multiple events from block 203. After block 203, flow 20 proceeds to query block 205.

In block 205, a query is done to determine if the user is finished creating, selecting, managing, and/or entering all event data. If the user is not finished with entering, selecting, editing, or managing event data, then flow 20 will flow back to block 203 so that the user is given the chance to finish all data entry and managing of event data. If a user has completed the process of entering, selecting, editing, and/or managing events/appointments, then flow 20 will proceed to query block 207. In block 207, a query is done to determine if the user has finished inputting and/or selecting all contact data/information. If a user has finished entering and/or selecting all contact data/information, then flow 20 will proceed to block 209. If a user has not finished or completed the process of inputting, managing, or editing all contact information, then flow 20 may proceed to block 204 so that the user can complete the process of entering, editing, or managing contact data.

In block 204, a user is provided with the opportunity to create, select pre-existing contact data, edit, input, view, print, and manage contact data associated with emergency contacts. In block 204, the user will be allowed to create several emergency contacts, such as friends, family members, and the like and/or to select pre-existing contacts that the user would like the present invention to notify in the event that the new event/appointment does not go well. In creating the emergency contacts, a user may be allowed to enter various data about the emergency contacts, such as name, telephone number, address, relationship to user, and the like. A user is also given the chance to select pre-existing contact data as emergency contact data and is also given the ability to add any additional information about a particular emergency contact. The user is also allowed to rank the emergency contacts in a priority configuration whereby the present invention may contact the emergency contacts based upon the priority assigned by a user. The present invention is not limited to this configuration as in alternative embodiments, the user may choose to have the present invention notify all emergency contacts in the event that a message is generated and broadcast out to the emergency contacts.

After block 204, flow 20 may proceed to query block 206. In block 206, a query is done to determine if a user has finished creating, selecting, editing, viewing, and/or printing contact data. If the user is not completed with the contact data, then flow 20 may flow back to block 204 so that the user may finish his/her actions regarding contact data. If a user is completed with the contact data, then flow 20 may proceed to flow to query block 208.

In query block 208, a query is done to determine if the user has finished inputting and/or selecting all event data/information. If a user has finished entering and/or selecting all event data/information, then flow 20 will proceed to block 209. If a user has not finished or completed the process of entering managing, viewing, printing or editing all event data/information, then flow 20 may proceed to block 203 so that the user can complete the process of entering, selecting, managing, viewing, printing and/or editing event data.

In block 209, a user may enter and create messages that may be utilized by the present invention in the event that a message is generated and broadcast out to a user's emergency contacts. In entering and creating messages, a user may enter various messages or select any number of pre-existing messages provided by the present invention. A user is also given the chance to edit any of the pre-exiting messages should the user choose to do so. For example, if a user is on a blind date and the user is entering a message to be sent to an emergency contact in the event that the user is unable to check back in with the invention, the user may compose a message that states all data about the location of the blind date as well as identifying data about the individual who the user is meeting on the blind date. In other situations, the user may simply utilize a short simple message asking for immediate help. Any number of messages may be created by a user for use with the present invention. The present invention may also be configured so that a user is allowed to configure a check back in and/or reminder message that is sent to the user to remind the user that it is time for the user to check back in and report his/her status to the present invention before messages are sent to emergency contacts. For example, the present invention may send a user a message asking and/or reminding the user to check back in and update the user's status as being okay and/or safe so that an emergency message will not be sent to any emergency contacts. The present invention may also be configured to send multiple reminder messages at different time intervals to continuously remind the user to check back in. In such embodiment, the present invention may be configured with a specific reminder message threshold time limit, such as thirty and fifteen minutes, wherein a first reminder message may be sent and if the user fails to check back in within thirty minutes of the broadcasting of that first reminder message, then a second reminder message may be sent, and if the user fails to check back in after the second reminder message is sent, then the present invention will automatically generate and broadcast messages to the emergency contacts. The present invention is not limited to this configuration as the present invention may be configured to send out various reminder messages on any number of time intervals.

After block 209, flow 20 proceeds to query block 210. In query block 210, a query is performed to determine if a user if finished entering, managing, and/or editing message data. If the user is not completed entering, editing, or managing messages, then flow 20 may proceed back to block 209 so that the user can complete all actions regarding messages. In the event that the user has completed all actions regarding messages, then flow 20 may proceed to block 211.

In block 211, data analysis takes place. In one embodiment of the present invention, event/appointment data may be analyzed and compared to user profile data (such as threshold time limits established, entered, or chosen by a user) to determine what action, if any, the present invention should take with respect to the previously created messages and emergency contacts previously identified by the user. After the event data and threshold data is analyzed, flow 20 may proceed to report back block 212. At report back block 212, further analysis occurs to determine a user's status related to a particular event/appointment. For example, in an embodiment of the present invention, a user is provided with the opportunity to report back and/or check in with the present invention and input updated data and/or additional information related to the user's status for various events/appointments. In one embodiment, a user is able to enter data and/or answer a series of questions that may indicate that the user is safe, depending on the user's specific answers or data input. In other embodiments, a user may choose to extend the threshold time period or even opt to stop monitoring the particular event all together. After the analysis of user input data is conducted in block 212, flow 20 may proceed to query block 213.

In query block 213, a query is performed to determine if a user has reported back safely and/or otherwise entered data or made various data selections which indicate that the user is safe and the current event/appointment is progressing along safely and there is no need to notify any emergency contacts. Query block 213 may also perform additional queries depending on the specific configuration of the present invention. If a user has indicated that he/she is safe, then flow 20 may flow back to block 211 so that that data analysis may continue in order to constantly monitor the status of various appointments/events that have been input by a user. If a user has indicated that he/she is not safe, then flow 20 may proceed to block 214.

In block 214, messages, such as the message previously configured or selected by a user in block 209, will be generated and broadcast by the present invention to the various emergency contacts that were previously identified by a user. For example, if a user is on a business meeting with a new client at a new location that is expected to last a certain amount of time whereby the user has configured the present invention with a threshold time limit of 5 hours and the 5 hours threshold time limit has expired and the user did not check back in with the system to report safely or update the status of the appointment, then the present invention may generate and broadcast messages to any number of emergency contacts advising the emergency contacts of the user's message, which may include appointment/event data and of the fact that the user has not checked back in safely.

The present invention is not limited by the flow set forth in FIG. 2 as any number of alternative processes may be implemented to achieve the same aspects of the invention.

FIG. 3 illustrates computer system 300 adapted to use embodiments of the present invention, e.g. storing and/or executing software associated with the embodiments. Central processing unit (CPU) 301 is coupled to system bus 302. The CPU 301 may be any general purpose CPU. However, embodiments of the present invention are not restricted by the architecture of CPU 301 as long as CPU 301 supports the inventive operations as described herein. Bus 302 is coupled to random access memory (RAM) 303, which may be SRAM, DRAM, or SDRAM. ROM 304 is also coupled to bus 302, which may be PROM, EPROM, or EEPROM. RAM 303 and ROM 304 hold user and system data and programs as is well known in the art.

Bus 302 is also coupled to input/output (I/O) controller card 305, communications adapter card 311, user interface card 308, and display card 309. The I/O adapter card 305 connects storage devices 306, such as one or more of a hard drive, a CD drive, a floppy disk drive, a tape drive, to computer system 300. The I/O adapter 305 is also connected to printer 314, which would allow the system to print paper copies of information such as documents, photographs, articles, etcetera. Note that the printer may be a printer (e.g. dot matrix, laser, etcetera.), a fax machine, scanner, or a copier machine. Communications card 311 is adapted to couple the computer system 300 to a network 312, which may be one or more of a telephone network, a local (LAN) and/or a wide-area (WAN) network, an Ethernet network, and/or the Internet network. User interface card 308 couples user input devices, such as keyboard 313, pointing device 307, etcetera to the computer system 300. The display card 309 is driven by CPU 301 to control the display on display device 310.

Although the present invention and its advantages have been described in detail, it should be understood that various changes, substitutions and alterations can be made herein without departing from the invention. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized.

The invention claimed is:

1. A method for identifying when an individual may be involved in a potential dangerous situation and for notifying others about said potential dangerous situation using a processor to perform the following steps:

gathering unique data about a user;

gathering unique data about an event involving said user;

gathering unique contact data about one or more emergency contacts;

creating one or more messages;

analyzing said unique event data and said unique user data to determine status of said user; and broadcasting at least one of said messages to at least one of said emergency contacts if said analyzing step reveals that said status of said user is unsafe.

2. The method of claim 1 wherein said unique data about said user comprises one or more of:

name of user;

contact data for said user;

payment information for said user;

user id; and user password.

3. The method of claim 2 wherein said unique data about said event comprises one or more of:

description of event;

date of event;

time of event;

name and contact data of individual attending said event with said user;

location of event;

length of time said user has known said individual; and when said event was planned; and event specific threshold time limit before broadcasting of at least one of said messages occurs.

4. The method of claim 3 wherein said unique contact data about one or more of said emergency contacts comprises one or more of:

name of emergency contact;

telephone number of said emergency contact;

email address of said emergency contact;

address of said emergency contact; and relationship of said emergency contact to said user.

5. The method of claim 4 wherein said one or more messages comprises one or more of:

a request for help from said user; and a notification that said user was attending said event with said individual and said user has not checked in safely.

6. The method of claim 5 wherein said analyzing step comprises the steps of:

querying said unique user data to identify said default time limit before broadcasting of at least one of said messages occurs;

querying said unique event data to identify said event specific threshold time limit before broadcasting of at least one of said messages occurs;

prompting said user to provide a safe reply message indicating that said user is safe wherein said prompting occurs prior to the expiration of said event specific threshold time limit before broadcasting of at least one of said messages occurs;

determining whether said user provided said safe reply message in response to said prompting; and generating a signal that said status of said user is not safe if said safe reply message is not received from said user.

7. The method of claim 6 wherein said broadcasting step comprises one or more of:

querying said emergency contacts and said unique contact data about one or more of said emergency contacts;

gathering said one or more messages and broadcasting said gathered message to said one or more emergency contacts;

generating and broadcasting to said emergency contacts one or more of:

a sound signal;

a vibration signal;

a light signal;

an email;

a text message; and a telephone call.

8. The method of claim 7 further comprising:

storing said unique user data;

storing said unique event data;

storing said unique emergency contact data;

storing said created messages; and storing said broadcasted messages.

9. A system for monitoring a user's status and for communicating the user's status comprising:

means for creating a user profile for a user;

means for gathering data about an event from said user;

means for gathering emergency contact data about one or more emergency contacts;

means for generating one or more messages;

means for gathering unique threshold data related to said user;

means for gathering data about said user's status;

means for comparing said unique threshold data to said user's status; and means for broadcasting said one or more messages.

10. The system of claim 9 further comprising:

means for storing said user profile;

means for storing said event data;

means for storing said messages; and means for storing said threshold data.

11. The system of claim 9 wherein said means for creating a user profile for a user comprises:

means for prompting a user to enter said user's name;

means for prompting a user to enter said user's contact information wherein said contact information comprises one or more of:

email address;

home telephone number;

work telephone number; and mobile telephone number;

means for prompting a user to create a user id and password to be associated with said user profile; and means for prompting a user to enter payment information for said user associated with use of said system.

12. The system of claim 11 wherein said means for gathering data about an event from said user comprises:

means for providing a user with the choice to create an event by entering data about said event wherein said entered event data comprises one or more of:

description of said event;

date of said event;

time of said event;

location of said event;

name of individual(s) attending said event with said user;

length of time that said user has known said individual (s); and date said event was initially scheduled;

means for scanning and gathering data about pre-existing events; and means for providing a user with the choice to create an event by selecting any of said gathered data associated with said pre-existing events.

13. The system of claim 12 wherein said means for gathering emergency contact data about one or more emergency contacts comprises:

means for providing a user with the choice to create an emergency contact by entering data about said emergency contact wherein said entered emergency contact data comprises one or more of:

name of said emergency contact;

email address of said emergency contact;

home telephone number of said emergency contact;

work telephone number of said emergency contact;

mobile telephone number of said emergency contact; and relationship with said emergency contact;

means for scanning and gathering data about pre-existing contacts; and means for providing a user with the choice to create an emergency contact by selecting any of said gathered data associated with said pre-existing contacts; and means for providing a user with the chance to review the emergency contact data and supplement said emergency contact data.

14. The system of claim 13 wherein said means for gathering unique threshold data comprises:

means for providing a user with the choice to create unique threshold data wherein said threshold data comprises:

a first time limit within which said user is to update said user's status;

a second time limit within which said user is reminded to update said user's status; and a third time limit for signaling said system to broadcast messages to said emergency contacts;

means for scanning and gathering pre-existing threshold data; and means for providing a user with the choice to create threshold data by selecting any of said gathered data associated with said pre-existing threshold.

15. The system of claim 14 wherein said means for gathering data about said user's status comprises:

means for providing a user with the chance to update said user status wherein said user status data comprises one or more of:

user is safe;

user is in trouble;
user needs assistance;
user has checked back in and is in danger;
user has checked back in and is safe; and
user has not checked back in.

16. The system of claim 15 wherein said means for comparing said unique threshold data to said user's status data comprises;

means for analyzing said threshold data;
means analyzing said user status data;
means for comparing said analyzed threshold data to said analyzed user status data to determine if said comparison reveals that said user may be in danger; and
means for generating a danger signal if said comparison reveals that said user may be in danger.

17. The system of claim 16 wherein said means for broadcasting said one or more messages comprises:

means for detecting the existence or non-existence of said generated danger signal; and
means for communicating said one or more messages to said emergency contacts upon detecting the existence of said generated danger signal.

18. A computer readable medium with computer program logic recorded thereon for notifying selected emergency contacts when a user may be in trouble, said computer program logic comprising:

code for creating a user profile;
code for storing said created user profile;
code for creating emergency contacts;
code for storing said emergency contacts;
code for creating events;
code for storing said events;
code for creating threshold data specific to said events;
code for creating user status;
code for creating messages;
code for updating said user status during said event;
code for analyzing said user status and said threshold data to determine if said user is potentially in danger;
code for detecting when said user is potentially in danger in response to said analysis;
code for communicating said messages to said emergency contacts.

19. The computer readable medium of claim 18 wherein said code for creating threshold data specific to said events further comprises:

code for selecting an overall time limit within which a message will be communicated to all emergency contacts; and
code for providing a choice to communicate said messages to emergency contacts or not to communicate messages to said emergency contacts.

20. The computer readable medium of claim 19 wherein said code for creating emergency contacts further comprises:

code for providing a choice to enter new emergency contact information to select pre-existing emergency contact information.

* * * * *